US008696769B2

(12) United States Patent
Ford

(10) Patent No.: US 8,696,769 B2
(45) Date of Patent: Apr. 15, 2014

(54) FUEL ADDITIVE TO INCREASE FUEL EFFICIENCY AND REDUCE EMISSIONS

(76) Inventor: Don Ricardo Oniel Ford, Claremont, CA (US)

( * ) Notice: Subject to any disclaimer, the term of this patent is extended or adjusted under 35 U.S.C. 154(b) by 0 days.

(21) Appl. No.: 13/354,314

(22) Filed: Jan. 19, 2012

(65) Prior Publication Data

US 2012/0180384 A1 Jul. 19, 2012

Related U.S. Application Data

(60) Provisional application No. 61/461,526, filed on Jan. 19, 2011.

(51) Int. Cl.
*C10L 1/185* (2006.01)
*C10L 1/188* (2006.01)

(52) U.S. Cl.
USPC ..... 44/446; 44/447; 44/448; 44/449; 44/451; 44/452

(58) Field of Classification Search
USPC ..... 44/446, 447, 448, 449, 451, 452
See application file for complete search history.

(56) References Cited

U.S. PATENT DOCUMENTS

2002/0072288 A1* 6/2002 Hei et al. ..... 442/59

* cited by examiner

*Primary Examiner* — Pamela H Weiss
(74) *Attorney, Agent, or Firm* — Donn K. Harms

(57) ABSTRACT

A fuel additive to gasoline and diesel fuels which when added in small quantities relative to total volume of fuel treated and burned as fuel in an internal combustion engine, enhances fuel burning to concurrently increase mileage and reduce emissions. The fuel additive is formed of a plurality of individual components having individual and a combined synergistic effect along a liquid fuel-soluble carrier and added to the fuel supply of the intended internal combustion engine.

5 Claims, 1 Drawing Sheet

COMPONENT ADDITIVE CONCENTRATE 41-51% Acetophenone 10-15% Diethyl Ether 8-12% Dibutyl ether 15-17% 2-Ethylhexanol 5-14% 2-Ethylhexanoic Acid

COMPONENT ADDITIVE CONCENTRATE

41-51% Acetophenone 10-15% Diethyl Ether 8-12% Dibutyl ether 15-17% 2-Ethylhexanol 5-14% 2-Ethylhexanoic Acid

FIG. 1

FUEL –SOLUBLE ALCOHOL

52%-57% Ethanol 34-38% Benzyl Alcohol

FIG. 2

FUEL ADDITIVE TO INCREASE FUEL EFFICIENCY AND REDUCE EMISSIONS

This application claims priority to U.S. Provisional Patent Application Ser. No. 61/461,526, filed on Jan. 19, 2011 and incorporated herein in its entirety.

BACKGROUND OF THE INVENTION

1. Field of the Invention

The present invention relates to a fuel additive formed of a plurality of individual components having individual and a combined synergistic effect when mixed with hydrocarbon fuel commonly employed in internal combustion engines. Mixed with the fuel employed by an engine in very small quantities, the fuel and additive mixture results in an increase in available horsepower, improved torque, and reduced fuel consumption, all while concurrently causing a substantial reduction in pollutants and greenhouse gases from the exhaust from the burned fuel.

2. Prior Art

Since the early 1990s there has been increased concern with regard to pollutants which enter the atmosphere. A particular concern has been raised concerning pollutants resulting from exhaust from internal combustion motors which burn hydrocarbon based fuels. There is a particular concern with regard to such emissions related to greenhouse gases and the unproven theory of global warming caused thereby.

With concern has come government regulations which have provided a need to find new fuel mixtures which will aid in engine combustion and result in reductions of exhaust components of carbon dioxide, nitrous oxide (NOx), and similar gases. One theory by scientists purports that increases of nitrous oxide gases occurring since the introduction of the catalytic converter on automobiles, are a particular problem. Such nitrous oxide emissions are purported to be 1000 times more potent than $C0_2$ in adverse effects on the atmosphere.

Thus, in addition to the need for engine fuels which can be made to increase engine performance and thus require less fuel over time, there is a concurrent need to reduce tailpipe exhaust pollutants such as nitrous oxides. Both goals of course must be accomplished without affecting engine performance.

Internal combustion engines, in most countries, run for the most part on liquid fuels such as gasoline and diesel fuel which are primarily derived by the refinement of crude oil. The burning of such fossil fuels, and in particular crude oil derived vehicle fuels such as gasoline and diesel, provide an easily transportable reservoir of energy for a mobile engine.

However, the burning of conventionally refined fuel in such engines, is less than completely efficient. As a consequence of such inefficient combustion, engines employing conventional gas and diesel fuel suffer from excess fuel consumption, engine knock, and carbon build up on valves, cylinder heads and pistons. Performance problems and deposits further exacerbate the problems of pollutants in the exhaust, as well as lessening of motor efficiency and resulting mileage. Further, despite modern engines with electronic controls and sensors, engines using gasoline and diesel fuels continue to expel exhaust which contribute pollutants and greenhouse gases to the atmosphere such as NOx (oxides of Nitrogen), unburnt He (hydrocarbons), CO (Carbon Monoxide), $NO_2$ (nitrogen dioxide), and NO (nitric oxide). Engines using diesel fuel can add significant diesel particulate matter to the mix of tailpipe problems.

Much of these problems with conventional fuels can be attributed to inconsistent burning of the fuel in the cylinders as well as the effects of prior years of burning such fuels and the aforementioned engine deposits and wear therefrom. In recent decades, many various fuel additives have been proposed and provided in attempts to improve fuel economy and reduce combustion exhaust pollutants. Such additives, however, have, to date, failed to concurrently address the issues of unburnt fuel in the exhaust as well as partially burnt fuel both of which impart pollution to the atmosphere.

Much prior art has taught and suggested adding various combustion enhancers for the various types of internal combustion engine fuels. There is a wide variance on the enhancements claimed and taught by such prior art additives which are provided in a diverse forms. Most are taught as being in either a liquid state mixed with liquid carriers and some are taught in a solid state to be mixed with fuels as directed in prior attempts to rectify the problem.

For example, US Published application 2005/0044778 of Orr teaches the use of metallic vapor phase fuel compositions relating to a broad spectrum of pollution reduction and improved combustion performance using diesel, gasoline, and other fuels. Orr employs co-combustion agents such as trimethoxymethylsilane.

U.S. Published application US2008/0250703 of Krogh et al, teaches fuel additives for reduction of nitrogen oxide and particulate emissions from the exhaust stream of internal combustion engines. Preferred embodiments of an additive of Krogh include a nitrogen containing compound selected from the group consisting of urea, cyanuric acid, triazine, ammonia and mixtures thereof, a carrier blend comprising an alkoxylated alcohol, a polyalkylene glycol ester and an alkanolamide and water.

Other attempts continue to provide an additive for fuels such as gasoline and diesel fuel with the twin goals of reducing pollutants and increasing performance and concurrently vehicle economy. However to date, none appear to be successfully on the market.

As such, there is a continuing and unmet need for an additive for fuel which will in small quantities relative to total treated fuel, will remedy the downside of the employment of such modern fuels in powering gasoline and diesel engines. Such an additive in addition to providing improvements in burning of fuels during combustion to increase engine efficiency and thereby reduce fuel costs, should provide a significant decrease in pollutants and in dust in exhaust gases. Ideally such a fuel additive should save more in fuel and wear and tear over time, than the cost of the additive. Finally, such an additive should be easily mixed with fuel by normal users so as to allow widespread use.

Further, it should be noted that while the prior art reveals numerous treatments for fuel, it does not disclose the unique combination of additive components herein to yield the component additive to hydrocarbon fuel herein, or teach their use in the herein disclosed synergistic combination for providing enhanced power extraction, and concurrent pollutant reduction with engines employing such fuels.

SUMMARY OF THE INVENTION

The fuel additive composition disclosed herein is adapted for an easy inclusion, in minor amounts relative to the major amount of a hydrocarbon fuel such as gasoline or diesel fuel being treated. So mixed, the fuel additive herein alters the molecular structure of the fuel resulting in enhanced burning characteristics which can be employed by vehicles worldwide to increase performance and mileage and reduce exhaust pollutants. The resulting mixture of the fuel-soluble additive composition herein, formed of a mixture of additive components and a fuel-soluble liquid carrier, yields significant performance benefits and reductions in pollutants and greenhouse gases.

Any of the disclosed variations of the additive provides an easy-to-employ treatment for gasoline and diesel fuels, when mixed with such fuels in the disclosed ratios. The combination of components in the additive, when diluted into the proper amount of fuel, has a synergistic action upon that fuel. This causes the molecular chains in the fuel molecules to shorten. These smaller molecules yield a larger surface-to-volume ratio, compared to longer molecular chains. The resulting larger relative surface areas enable a better attraction of negatively charged oxygen molecules. This effect, in turn, thereby produces a more efficient and complete combustion of the fuel, once the fuel is ignited.

Thus, fuel treated with the component additive herein, yields a much more efficient combustion of the fuel during each power stroke of the engine in which that fuel is employed. In addition to increased power and efficiency, the more efficient combustion also results in a concurrent reduction of emissions of NOx: (oxides of nitrogen) previously sunburnt He (hydrocarbons), CO (Carbon Monoxide), $NO_2$ (nitrogen dioxide), NO (nitric oxide), DPM (diesel particulate matter) due to the more consistent uniform fuel burning with each power stroke of the engine.

The improved power output for each gallon of treated fuel that is combusted leads to an increase in mileage per gallon of fuel, for vehicles that employ the treated fuel.

In use, the component additive combined, to the noted percentages by volume, with a liquid "carrier", is added to the fuel tank of a vehicle. The preferred ratio of the additive-carrier mixture to fuel is one ounce to 10 gallons of fuel for diesel engines and one ounce to 10-15 gallons of gasoline for gasoline engines. The component additive concentrate can be provided in volume, and diluted in the fuel tank or fuel line in an ongoing fashion, using onboard reservoirs of the concentrate and the carrier to conserve on space and provide the benefits in volume, to achieve the desired ratio of the additive-and-carrier mixture to fuel. The component additive concentrate can also be provided to local distributors who mix it in the proper volume relative to the liquid carrier, to create the appropriate mixture that can be combined with fuel. Finally, the component additive concentrate and carrier can be mixed in proper percentages of total volume and then placed in containers which users can purchase and pour into the fuel tank during filling. In use, the component additive, combined, in the noted percentages by volume, with a liquid carrier, is added to the fuel tank of a vehicle.

With respect to the above description, before explaining at least one preferred embodiment of the herein disclosed invention in detail, it is to be understood that the invention is not limited in its application to the details of construction and to the mixtures and percentages in the following description or illustrated in the drawings. The invention herein described is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for mixing and formulating other fuel additive compositions adapted for carrying out the several purposes of the present disclosed device. It is important, therefore, that the claims be regarded as including such equivalent construction and methodology insofar as they do not depart from the spirit and scope of the present invention.

It is an object of the present invention to increase fuel economy and reduce fuel consumption of internal combustion engines using fuel treated with the additive composition herein.

It is another object of this invention to reduce combustion emissions in gasoline and diesel powered internal combustion engines and consequently reduce greenhouse gases vented in the exhaust of engines employing fuel treated herewith.

It is a further object of the present invention to provide an additive for fuel which is employed in small quantities relative to fuel treated and yields sufficient increased efficiency to substantially equal the cost of the additive.

Further objects of the invention will be brought out in the following part of the specification, wherein detailed description is for the purpose of fully disclosing the invention without placing limitations thereon. The objects, advantages and embodiments of the present invention are described in the specification those skilled in the art on reading such will discern previously undiscovered advantages and uses which will be obvious subsequent to reading the specification, claims, or from the practice of this invention. Therefore, it is understood that the invention as claimed and described or obvious after reading this disclosure, fall within the scope of the appended claims.

BRIEF DESCRIPTION OF DRAWING FIGURES

FIG. 1 shows a view of table of the ingredients of the additive composition of a concentrate thereof adapted for mixing in a fuel-soluble carrier such as that of FIG. 2.

FIG. 2 shows a table of mixture ingredients for the preferred fuel-soluble carrier for mixing with the additive ingredients of FIG. 1.

DETAILED DESCRIPTION OF THE PREFERRED EMBODIMENTS OF THE INVENTION

As shown in the figures and described herein, the additive composition can be provided as a concentrate which may be later diluted using a fuel-soluble carrier, or can be mixed with the fuel-soluble carrier and provided in a pre-mixed manner where it is placed in the fuel tank of the internal combustion engine.

As shown in FIG. 1, the component additive consists of a plurality of components mixed in ranges to achieve the concentrate additive mixture. The concentrate additive mixture is then mixed with the fuel-soluble liquid carrier in a ratio of between 5.5-10 percent of the mixed components in concentrate to the total volume of the mixed concentrate and the liquid carrier. For example between 5.5-10 ounces of the additive concentrate, in a total volume mixture of additive concentrate and liquid carrier of 100 ounces.

Currently a particularly preferred ratio is substantially 7.4% of the mixed components in concentrate to the total volume of mixed concentrate and liquid carrier to achieve a 7.4% by volume of the components of concentrated additive to the total volume of the additive concentrate and liquid carrier mix.

As shown in FIG. 1, the components of the component concentrate include as a percentage of the total volume of the component additive concentrate, from 41-51% Acetophenone and 10-15% Di Ethylene Ether, and 8-12% Di Buthyl Ether, and 15-17% Ethyl Hexanol 2, and 5-14% Ethyl hexanoic Acid 2. Currently, a mix of the individual components above in an amount substantially at the middle of each indicated range for the component noted and shown in FIG. 1, relative to the total volume of the mixed concentrate, is a particularly favored mixture which works particularly well to increase engine performance and maximize pollutant reduction.

The final mixture of additive concentrate components is diluted to a soluble carrier, after a mixture of the desired percentages by volume of the different additive concentrate components is achieved. The mixture of liquid carrier and component additive concentrate should contain 6-9% by volume of the mixed component additive concentrate. Currently a final mixture where the component additive concentrate is substantially 7.5% by volume of the total volume of the component additive concentrate/liquid carrier mixture is particularly favored, yielding excellent performance and reduction of pollutants.

The liquid carrier for the concentrate, is preferably the components noted in FIG. 2 of 52%-57% of Organic or Synthetic Alcohol such as Ethanol 200 or SDA-3-A and 34%-38% Benzyl Alcohol as total respective percentages of the volume of the liquid carrier. A mid range of both percentages of both carrier components is currently preferable. However, it can be mixed to the noted higher or lower limits by volume and achieve exceptional results.

In use, the component additive with liquid carrier mixed to the noted percentages by volume, is added to the fuel tank of a vehicle preferably at the rate of one ounce to 10 gallons of fuel for diesel engines and one ounce to 10-15 gallons of fuel for gasoline for gasoline engines. The component additive concentrate can be provided in volume and diluted in the fuel tank or fuel line in an ongoing fashion using onboard reservoirs of the concentrate and the carrier to conserve on space and provide the benefits in volume. Or, the component additive concentrate can be provided to local distributors who mix it in the proper volume relative to the liquid carrier to which it is mixed to achieve the fuel tank ready mixture. Finally, the component additive concentrate and carrier can be mixed in proper percentages of total volume and then placed in containers for use by vehicle owners who would add it to their fuel tank.

Testing of the component additive invention herein has shown that engines having the additive/carrier mixture mixed with the engines' fuel, in the noted ratios, have significantly decreased gas emissions in the exhaust from the engine, and also have increased power with resulting mileage increases. Consequently, the addition of the component additive invention herein, to the fuel of vehicles, will save money over time, because of increased fuel efficiency, reduced costs for fuel, and fewer repairs to the fuel and combustion systems of the engine.

The additive/carrier composition herein described and disclosed has been described in terms of ratios based on volume. It is readily apparent that the relevant ratios may be determined equally well on a weight basis, or a volume to weight basis, and such is anticipated.

While all of the fundamental characteristics and features of the invention have been shown and described herein, this invention is susceptible to considerable variation in its practice by those skilled in the art. Therefore the foregoing description is not intended to limit in any fashion, and should not be construed as limiting the invention to the particular exemplifications presented herein. Rather, what is intended to be covered is as set forth in the ensuing claims and the equivalents thereof permitted as a matter of law. Patentee does not intend to dedicate any disclosed embodiments to the public, and to the extent any disclosed modifications or alterations may not literally fall within the scope of the claims, they are considered to be part of the invention under the doctrine of equivalents.

Further, with reference to particular embodiments herein, a latitude of modification, various changes and substitutions are intended in the foregoing disclosure. It will be apparent that in some instances, some components of the additive of the invention may be employed without a corresponding use of others without departing from the scope of the invention as set forth. It should also be understood that various substitutions, modifications, and variations may be made by those skilled in the art, such as substituting the named compound with one from the same chemical group with equivalent or near-equivalent reactive characteristics, without departing from the spirit or scope of the invention. Consequently, all such modifications and variations and substitutions as would occur to those skilled in the art herein, and especially in the art of chemistry, are considered to be also included within the scope of the invention as defined by the following claims.

What is claimed is:

1. A fuel additive comprising; a first component which is a mixture comprising all of the following; Acetophenone, diethyl ether, dibutyl ether, 2-ethylhexanol, 2-ethylhexanoic acid a second component comprising a mixture by total volume 52%-57% Ethanol and 34%-38.00% Benzyl Alcohol; and said first component and said second component mixed to comprise said fuel additive where 6-9% of a total volume of said fuel additive by volume is comprised of said first component.

2. A fuel additive comprising;

a first component which is a mixture comprising all of the following; a first component comprising a mixture of 41-51% Acetophenone, 10-15% Di ethylether, 8-12% Dibutyl ether, 15-17% 2-ethylhexanol, and 5-14% 2-ethylhexanoic acid;

a second component which is a mixture comprising by total volume; 52%-57% Ethanol and 34%-38.00% Benzyl Alcohol; and said first component and said second component mixed to comprise said fuel additive where 6-9% of a total volume of said fuel additive by volume is comprised of said first component.

3. A fuel additive comprising the following;

A first component which is a mixture comprising all of the following; 45% Acetophenone, 12.5% diethyl ether, 10% dibutyl ether, 11% 2-ethylhexanol, 9.5% 2-ethylhexanoic acid;

a second component comprising a mixture by total volume 52%-57% Ethanol and 34%-38.00% Benzyl Alcohol;

and said first component and said second component mixed to comprise said fuel additive where 6-9% of a total volume of said fuel additive by volume is comprised of said first component.

4. The fuel additive mixture of claim 3, further comprising that the mixture shall include 7.5% of the first component and 92.5% of the second component by volume.

5. The fuel additive mixture of claim 3, further comprising that the mixture shall include 7.4% of the first component and 92.6% of the second component by volume.

* * * * *